US008100726B2

(12) United States Patent
Harlan et al.

(10) Patent No.: US 8,100,726 B2
(45) Date of Patent: Jan. 24, 2012

(54) WATERPROOF AUDIO JACK AND METHOD OF MAKING THE SAME

(75) Inventors: Tod M. Harlan, Mechanicsburg, PA (US); Richard Scott Kline, Mechanicsburg, PA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 119 days.

(21) Appl. No.: 12/732,431

(22) Filed: Mar. 26, 2010

(65) Prior Publication Data

US 2011/0237103 A1 Sep. 29, 2011

(51) Int. Cl.
*H01R 24/04* (2006.01)

(52) U.S. Cl. ..... 439/669; 29/883

(58) Field of Classification Search ..... 439/668, 439/669, 736, 593; 29/883
See application file for complete search history.

(56) References Cited

U.S. PATENT DOCUMENTS

| | | | | |
|---|---|---|---|---|
| 3,368,181 | A * | 2/1968 | Gimpel | 439/736 |
| 4,768,965 | A * | 9/1988 | Chang | 439/137 |
| 4,834,677 | A * | 5/1989 | Archang | 439/660 |
| 5,070,605 | A * | 12/1991 | Daglow et al. | 29/842 |
| 6,312,274 | B1 | 11/2001 | Lin | |
| 6,540,535 | B1 * | 4/2003 | Zhu et al. | 439/188 |

* cited by examiner

*Primary Examiner* — Neil Abrams
(74) *Attorney, Agent, or Firm* — Wei Te Chung; Andrew C. Cheng; Ming Chieh Chang

(57) ABSTRACT

An audio jack includes an insulative housing and a number of contacts retained therein. The insulative housing defines a receiving space for receiving a corresponding plug and a number of mounting holes extending inwardly from a mounting wall thereof. Each contact has a tail portion for connecting with a circuit board. A core pin is inserted into the receiving space and a plenty of elastomeric material is flowed into the mounting holes around the contacts to make the insulative housing being sealed except the receiving space. After the elastomeric material has solidified the core pin is withdrawn.

20 Claims, 10 Drawing Sheets

WATERPROOF AUDIO JACK AND METHOD OF MAKING THE SAME

BACKGROUND OF THE INVENTION

1. Field of the Invention

The present invention relates to audio jacks, more particularly to a waterproof audio jack sealed by elastomeric material and method of making the same.

2. Description of Related Art

In the consumer electronics world, many electrical devices, such as cellular phones, MP3 players and miscellaneous portable audio devices require the use of external audio earphones or head phones in order to hear the media sound. By using these earphones or headphones, audio jack must be provided in the audio devices to electrically connect with an audio plug which the earphones or headphones are plugged into to transmit audio signals. The audio jack usually includes an insulative housing having a cavity for the audio plug being plugged into and a set of receiving slots communicating with the cavity, and a set of contacts received in the receiving slots and protruding into the cavity for contacting with the audio plug. The receiving slots are usually recessed from one or more surfaces of the insulative housing and communicate with the exterior so as to allow the contacts inserted into the receiving slots from the respective surfaces. Besides, the receiving slots communicate with the cavity so as to allow the contacts electrically connecting with the audio plug.

When the audio plug is inserted into the cavity, the audio plug would seal the audio jack to prevent rainwater or other water from entering into the cavity and inflowing into the receiving slots, then migrating into the inside of the audio device. However, when the audio plug is pulled out of the cavity and not used, the rainwater or other water easily enters into the cavity and inflows into the receiving slots around the contacts, then the water would migrate into inside of the audio device and can not leak out of the audio device immediately and easily, which can cause an electrical short circuit or other damages to delicate the audio device.

Hence, an improved audio jack is desired to overcome the above problems.

BRIEF SUMMARY OF THE INVENTION

According to one aspect of the present invention, an audio jack comprises: an insulative housing defining a receiving space for receiving a corresponding plug and a number of mounting holes extending inwardly from a mounting wall thereof; and a number of contacts retained in the mounting holes, each contact having a tail portion for connecting with a circuit board; wherein a plenty of elastomeric material is filled into the mounting holes around the contacts to make the insulative housing being sealed except the receiving space.

According to another aspect of the present invention, a method of making an audio jack, comprises: providing an insulative housing with a receiving space which can be inserted into a corresponding plug and a number of mounting holes extending inwardly from a mounting wall thereof; providing a number of contacts and assembling the contacts into the mounting holes, each contact having a tail portion exposed to exterior for connecting with a circuit board; providing a core pin with a shape same to the receiving space and inserting the core pin into the receiving space; filling a plenty of elastomeric material into the mounting holes around the contacts; and pulling out of the core pin when the elastomeric material is fully filled in the mounting holes and cooled to be solidified.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
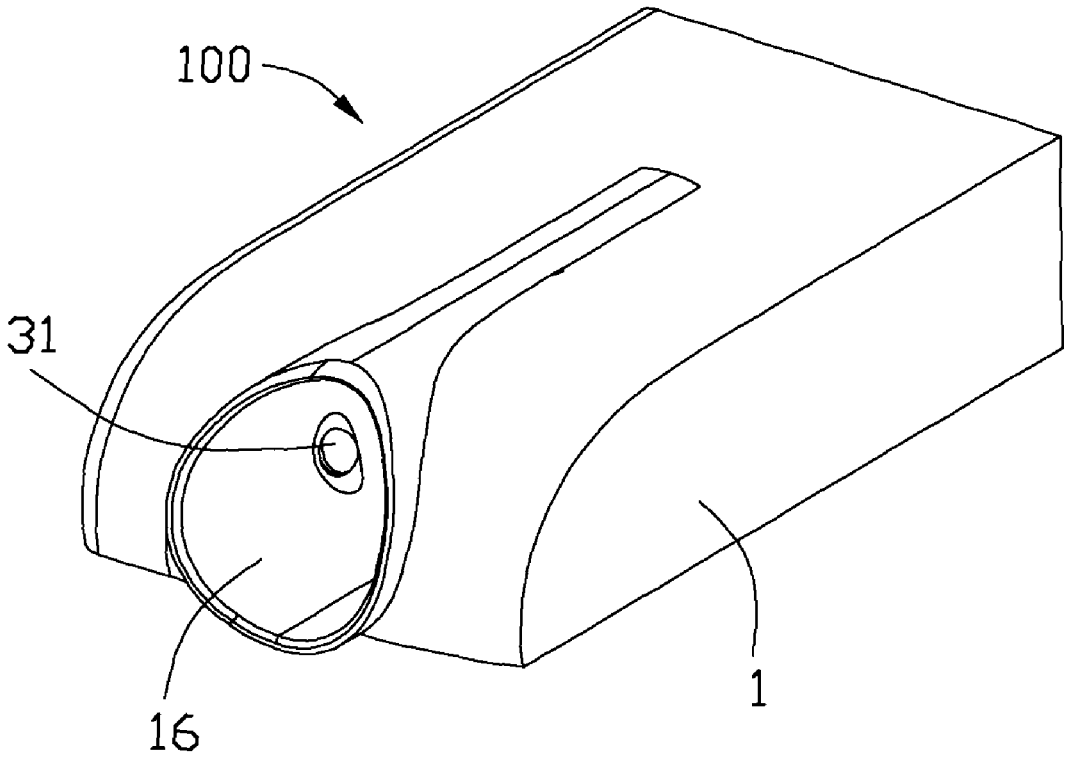
FIG. 1 is a perspective view of an audio jack according to a first embodiment of the present invention.
Figure 2:
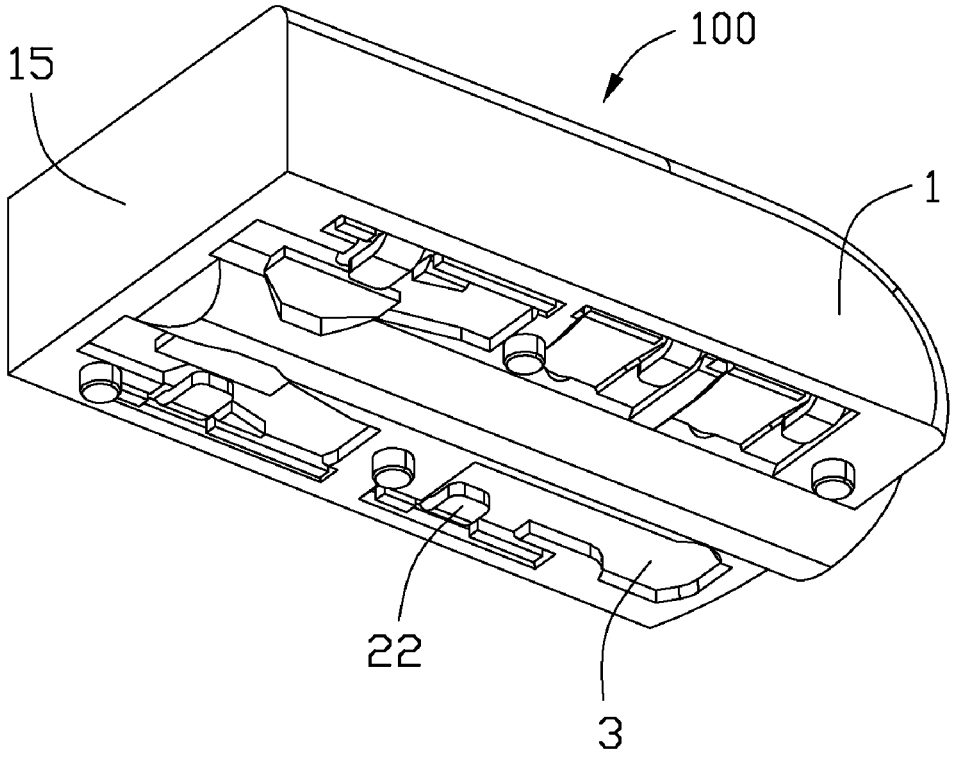
FIG. 2 is a view similar to FIG. 1, while taken from a different aspect.
Figure 3:
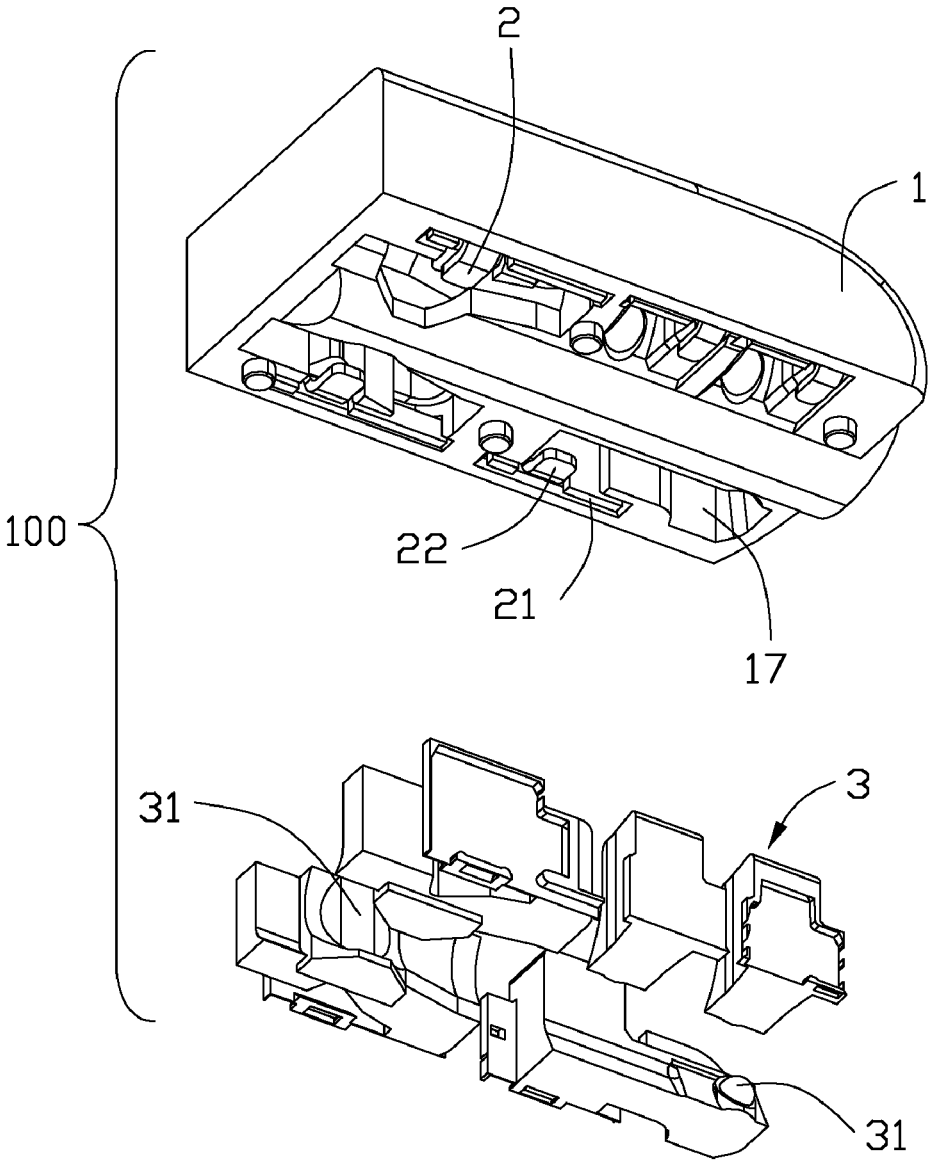
FIG. 3 is a partially exploded view of the audio jack shown in FIG. 2.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Referring to FIGS. 1-7, an audio jack 100 for soldering to a circuit board according to a first embodiment of the present invention comprises an insulative housing 1, a plurality of contacts 2 retained in the insulative housing 1 and a plurality of elastomers 3 formed in the insulative housing 1 around the contacts 2.

Figure 4:
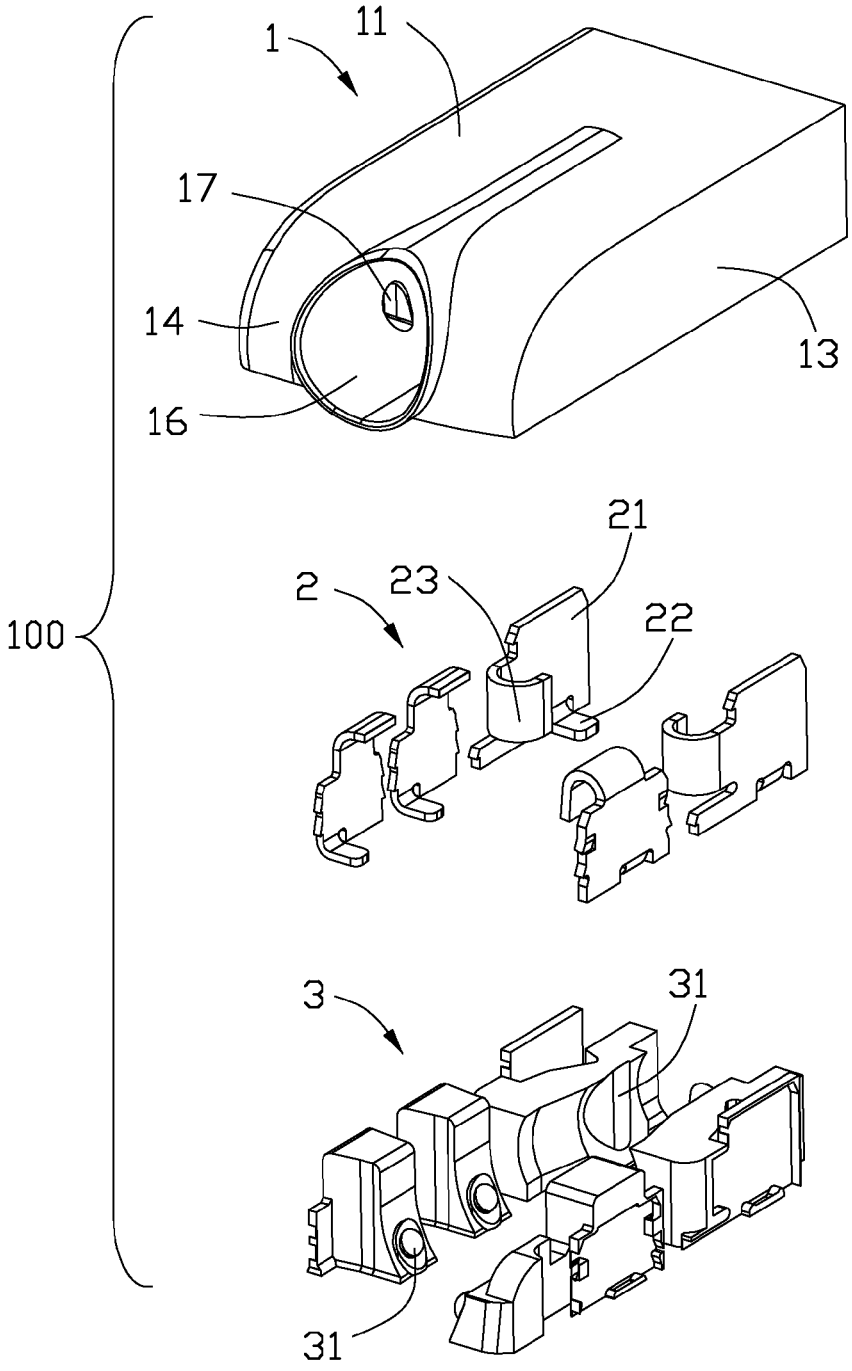
FIG. 4 is an exploded view of the audio jack shown in FIG. 2.
Figure 5:
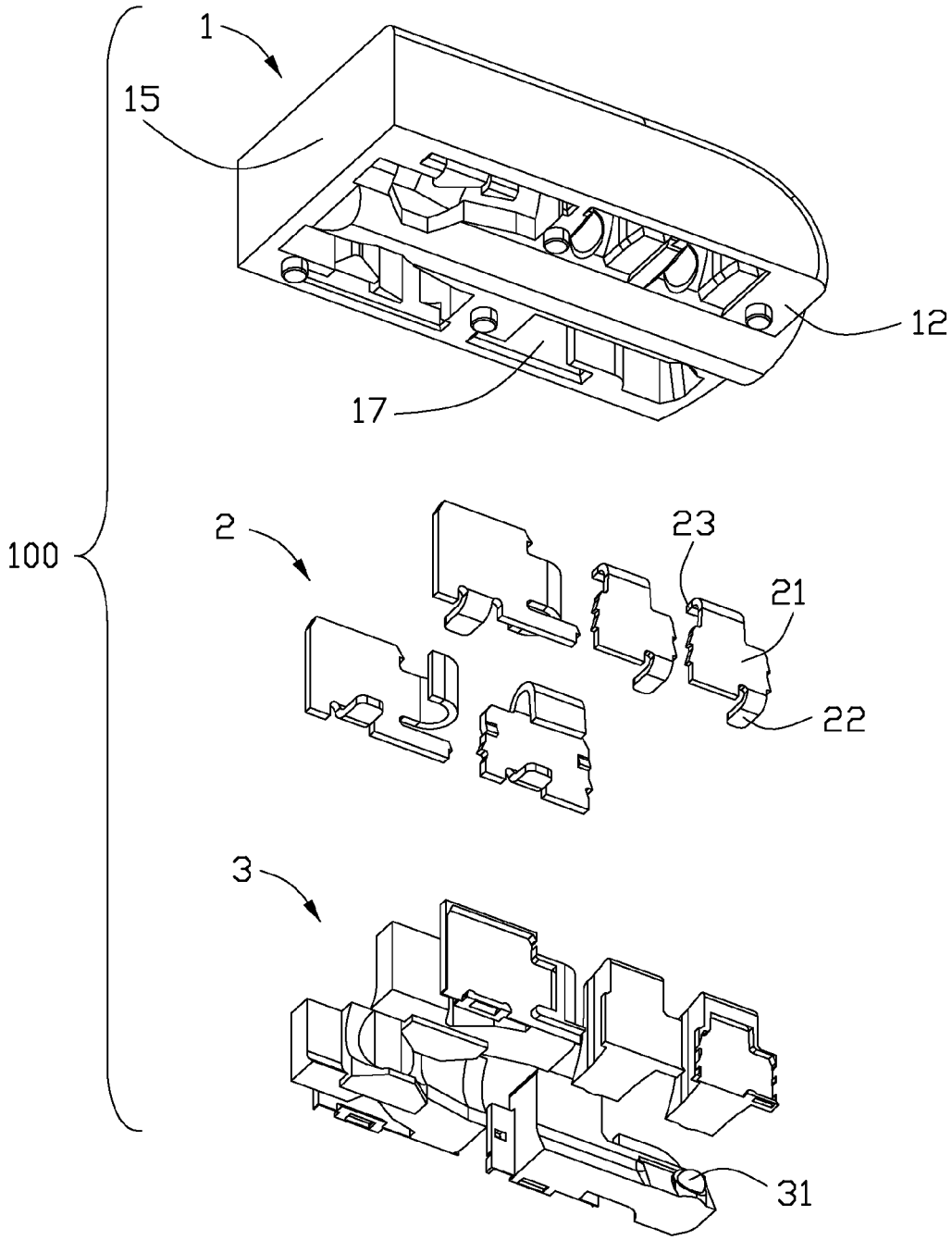
FIG. 5 is a view similar to FIG. 4, while taken from a different aspect.

Referring to FIGS. 4-5, the insulative housing 1 has a pair of opposite top wall 11 and mounting wall 12, a pair of side walls 13 and a pair of opposite mating wall 14 and rear wall 15. The insulative housing 1 defines a column receiving space 16 extending in an insertion direction of a corresponding plug (not shown) from the mating wall 14 for receiving the plug and a plurality of mounting holes 17 extending in a vertical direction perpendicular to the insertion direction from the mounting wall 12. The mounting holes 17 communicate with the receiving space 16 in a transverse direction perpendicular to the insertion direction and the vertical direction. The receiving space 16 is covered by the top wall 11, mounting wall 12, side walls 13 and rear wall 15 and opens forwardly, and downwardly through the mounting holes 17.

Each contact 2 has a retaining portion 21 retained in the mounting holes 17 of the insulative housing 1, a bending portion 23 bending inwardly from the retaining portion 21 and a tail portion 22 extending out of the mounting wall 12 and extending horizontally for being surface mounted to the circuit board.

The elastomers 3 are made of a plenty of conductive elastomeric material filled in the mounting holes 17 around the contacts 2 and spaced from each other, and seal the insulative housing 1 except the receiving space 16. Each elastomer 3 is formed with a mating portion 31 protruding into the receiving space 16 from the mounting hole 17 to electrically connect the plug and contacts 2. The elastomer 3 has a low hardness, therefore, the elastomers 3 can be compressed when the plug is inserted into the receiving space 16 and presses the mating portion 31, and rebound when the plug is pulled out of the receiving space 16.

Figure 6:
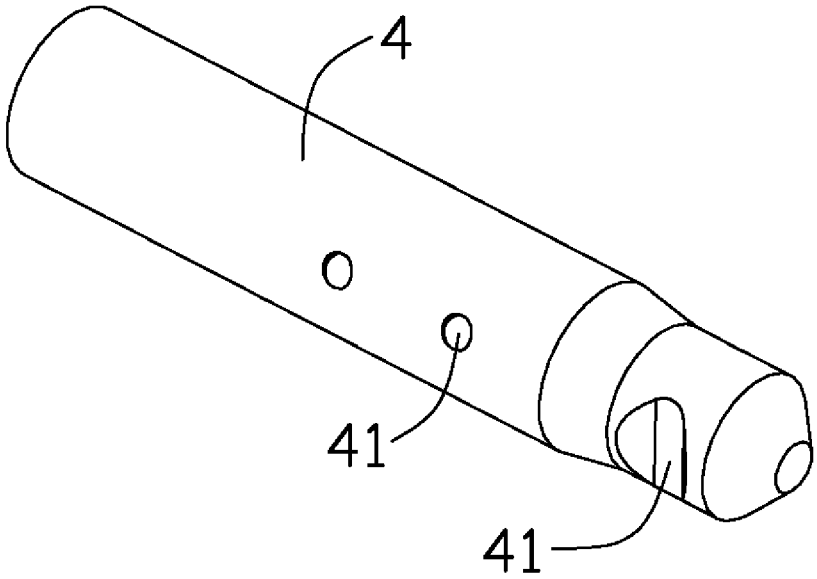
FIG. 6 is a perspective view of a core pin of the present invention.
Figure 7:
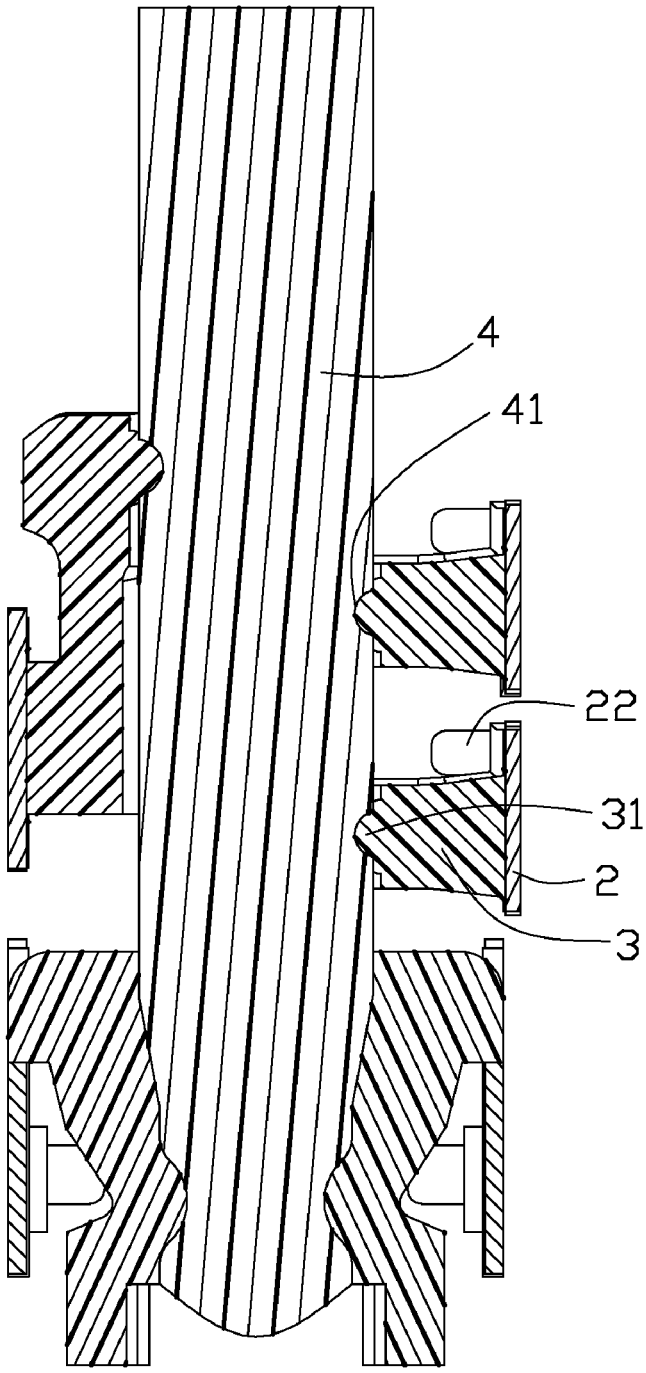
FIG. 7 is a cross-sectional view of a plurality of elastomers in the audio jack and the core pin inserted therebetween to show a plurality of mating portions of the elastomers being formed at a plurality of depressions of the core pin.

FIGS. 6 and 7 in the present invention shows a core pin 4 which can be inserted into the receiving space 16 between the elastomers 3 to prevent the elastomeric material from inflowing into the receiving space 16 in a molding process of the elastomers 3. The core pin 4 presents as a column corresponding to an inner side of the receiving space 16. The core pin 4 defines a plurality of depressions 41 at two sides thereof corresponding all the mating portions 31 respectively to form the mating portions 31.

A method or process of making the audio jack 100 has the following steps: firstly, providing said insulative housing 1 with said receiving space 16 and said mounting holes 17; secondly, providing the contacts 2 with said retaining portions 21 and tail portions 22 and assembling the contacts 2 into the mounting holes 17 from the mounting wall 12 in an up to down direction, then the retaining portions 21 are positioned in the mounting holes 17, and the tail portions 22 are located at an outside of the insulative housing 1; thirdly, providing said core pin 4 with the shape similar to the inner side of the receiving space 16 and inserting the core pin 4 into the receiving space 16; fourthly, filling the plenty of liquid conductive elastomeric material into the mounting holes 17, and the elastomeric material inflows into the depressions 41 of the core pin 4; finally, pulling out of the core pin 4 when the conductive elastomeric material is fully filled in the mounting holes 17 and the depressions 41 and cooled to be solidified to be formed as the elastomers 3, at this time, the bending portions 23 and retaining portions 21 of the contacts 2 are insert molded in the elastomers 3, the retaining portions 21 can be sandwiched between the elastomers 3 and inner side walls of the mounting holes 17, the elastomers 3 are formed with the mating portions 31 protruding into the receiving space 16 corresponding to all the depressions 41; then the insulative housing 1 is sealed by the elastomeric material except the receiving space 16;

Because the elastomers 3 have low hardness, the mating portions 31 of the elastomers 3 are deflected outwardly to let the core pin 4 escape from the receiving space 16 in the pulling process of the core pin 4, and rebound when the core pin 4 does not contact with the mating portions 31.

As fully described above, the audio jack 100 in the first embodiment of the present invention is formed with the elastomers 3 to seal holes 17 or apertures thereof except the receiving space 16, therefore, even the water can enter into the receiving space 16, but the water can not inflow into the mounting holes 17 around the contacts 2 and migrate into the circuit board of an audio device (not shown) which the audio jack 100 assembled in from the mounting holes 17, thereby the water can leak out of the receiving space 16 easily and can not cause an electrical short circuit or other damages to delicate the audio device. That is to say, the audio jack 100 in the present invention is waterproof to the audio device and can not be short.

Figure 8:
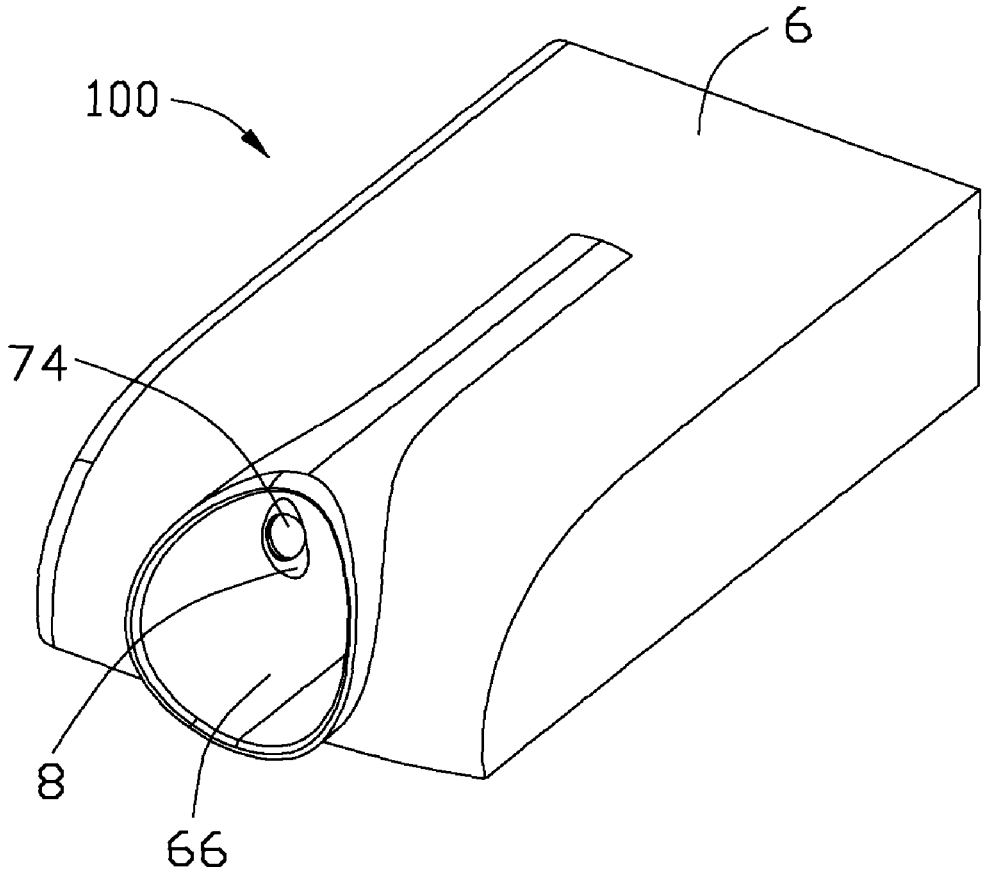
FIG. 8 is a perspective view of an audio jack according to a second embodiment of the present invention.
Figure 9:
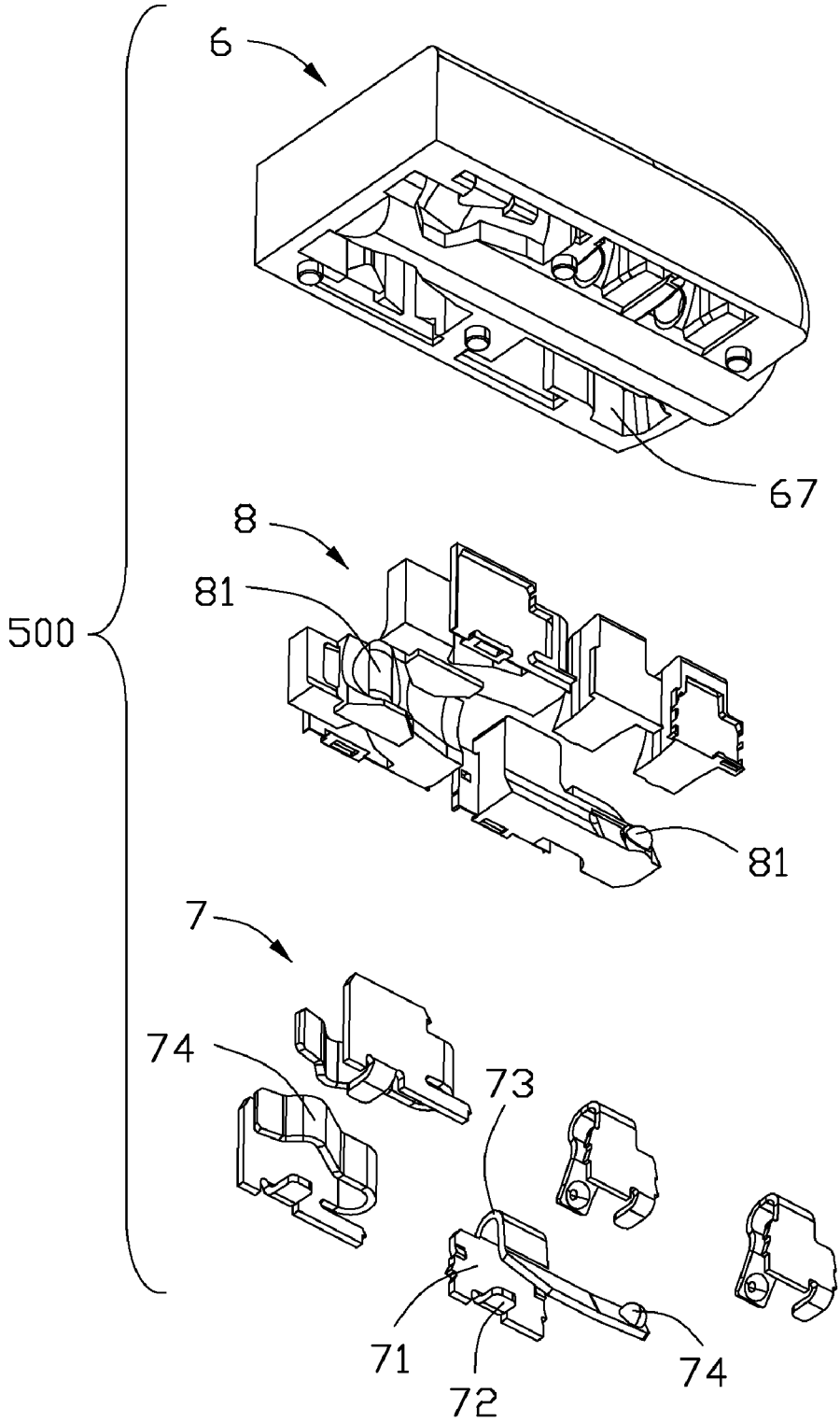
FIG. 9 is an exploded view of the audio jack shown in FIG. 8.
Figure 10:
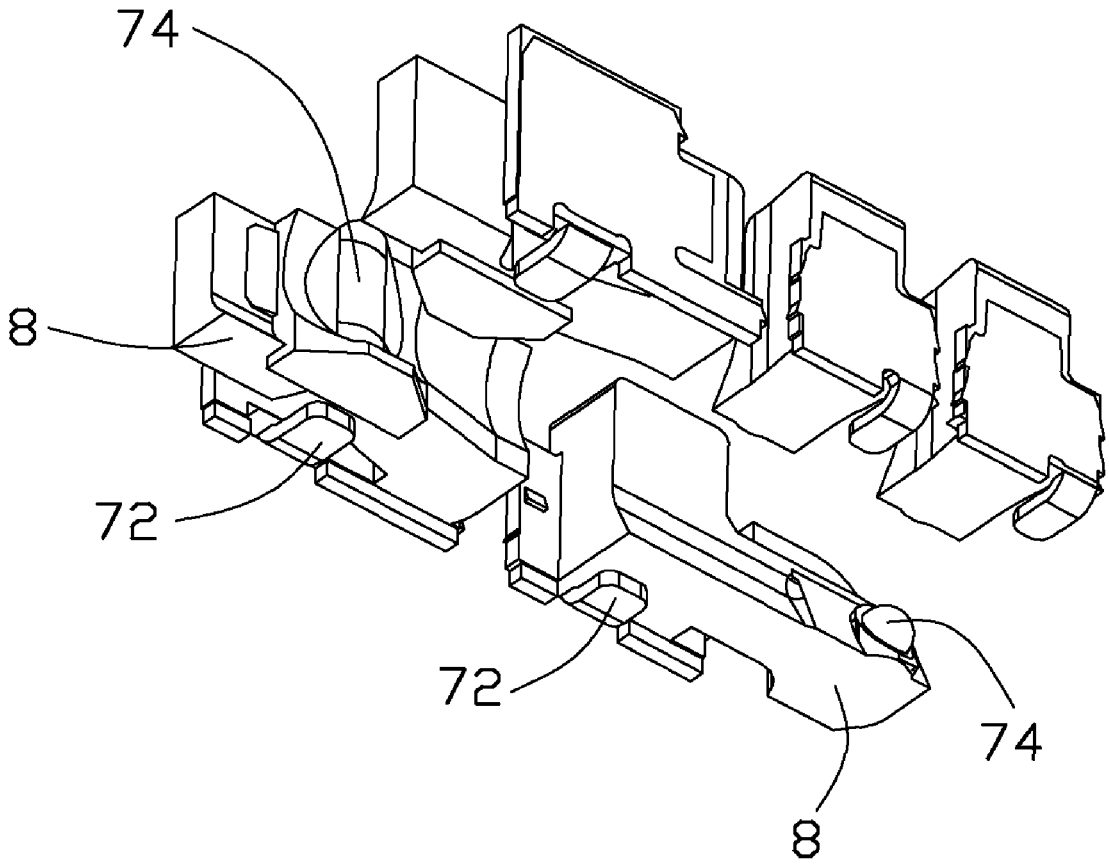
FIG. 10 is a plurality of elastomers and a plurality of contacts of the audio jack to show that the elastomers are formed behind a plurality of contact portion of the contacts.

Referring to FIGS. 8-10, an audio jack 500 according to a second embodiment of the present invention is disclosed. The audio jacks 100, 500 in the first and second embodiments are approximately similar to each other. The audio jack 500 in the second embodiment also has an insulative housing 6 with receiving space 66 and mounting holes 67 same to the insulative housing 1 in the first embodiment, a plurality of contacts 7 retained in the mounting holes 67 and a plurality of elastomers 8 molded around the contacts 7.

The contact 7 in the second embodiment also has a retaining portion 71 retained in the mounting holes 67, a bending portion 73 bending from the retaining portion 71 and a tail portion 72 extending out of the insulative housing 6 for soldering to the circuit board, but the contacts 2, 7 in the first and second embodiments are different and the difference is that: the contacts 2 in the first embodiment do not have metallic contact portions for electrically connecting with the plug directly, and the mating portions 31 extending into the receiving space 16 for electrically connecting with the plug and the contacts 2 are formed on the elastomers 3; while the contacts 7 in the second embodiment each has a metallic contact portion 74 extending into the receiving space 66 from the bending portion 73 thereof, and the elastomers 8 each is formed with a mating portions 81 at a rear side of the contact portion 74 to seal the insulative housing 6.

The elastomers 8 are made of a plenty of insulative elastomeric material filled in the mounting holes 67 around the contacts 7, and seal the insulative housing 6 except the receiving space 66. Each elastomer 8 is formed with the mating portion 81 protruding into the receiving space 66 from the mounting hole 67. The mating portions 81 are located at a rear side of the contact portions 74 to seal apertures around the contact portions 74. The elastomer 8 has a low hardness, therefore, the elastomers 8 can be compressed when the plug is inserted into the receiving space 66 and presses the contact portions 74, and rebound when the plug is pulled out of the receiving space 66.

A method and process of making the audio jack 500 in the second embodiment is similar to that in the first embodiment, and also has the following steps: firstly, providing said insulative housing 6 with said receiving space 66 and said mounting holes 67; secondly, providing said contacts 7 and assembling the contacts 7 into the mounting holes 67, then the retaining portions 71 are positioned in the mounting holes 67, the tail portions 72 extend out of the insulative housing 6, and the contact portions 74 extending into the receiving space 66 through the mounting holes 67; thirdly, providing said core pin 4 with the shape similar to the inner side of the receiving space 66 and inserting the core pin 4 into the receiving space 66, at this time, the contact portions 74 are received in the depressions 41 of the core pin 4; fourthly, filling the plenty of liquid insulative elastomeric material into the mounting holes 67, and the elastomeric material inflows into apertures at a rear side and outsides the contact portions 74 to form the mating portion 81; finally, pulling out of the core pin 4 when the conductive elastomeric material is fully filled in the mounting holes 67 and the apertures and cooled to be solidified to be formed as the elastomers 8, at this time, the contacts 7 are insert molded in the elastomers 8 except the contact portions 74 exposed to the receiving space 66 and tail portions 72 located at an outside of the insulative housing 1; then the insulative housing 6 is sealed by the elastomeric material except the receiving space 66.

Because the elastomers 8 have low hardness, the mating portions 81 of the elastomers 8 can be deflected outwardly when the core pin 4 pressed the contact portions 74 of the contacts 7 outwardly to let the core pin 4 escape from the receiving space 66 in the pulling process of the core pin 4, and rebound to let the contact portions 74 protrude into the receiving space 66 when the core pin 4 does not contact with the contact portions 74 of the contacts 7.

As fully described above, the audio jack 500 in the second embodiment is also formed with the elastomers 8 to seal the mounting holes 67 and apertures around the contact portions 74 except the receiving space 66 thereof, therefore, even the water enters into the receiving space 66, but can not inflow into the mounting holes 67 around the contacts 7 and migrate into the circuit board of an audio device (not shown) which the audio jack 500 assembled in from the mounting holes 67, thereby the water can leak out of the receiving space 16 easily and can not cause an electrical short circuit or other damages to delicate the audio device. That is to say, the audio jack 500 in the second embodiment of the present invention is also waterproof to the audio device.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An audio jack, comprising:

an insulative housing defining a receiving space for receiving a corresponding plug and a plurality of mounting holes extending inwardly from a mounting wall thereof; and a plurality of contacts retained in the mounting holes, each contact having a tail portion for connecting with a circuit board;

wherein a plenty of elastomeric material is filled into the mounting holes around the contacts to make the insulative housing being sealed except the receiving space.

2. The audio jack as claimed in claim 1, wherein the elastomeric material forms a plurality of elastomers around the contacts, and each contact has a retaining portion retained in the mounting holes and insert molded in the elastomer.

3. The audio jack as claimed in claim 2, wherein all mounting holes are formed with said elastomers respectively, and the retaining portions are sandwiched between the elastomers and insulative housing.

4. The audio jack as claimed in claim 2, wherein the elastomer is conductive and formed with a mating portion extending into the receiving space for electrically connecting the plug and contacts.

5. The audio jack as claimed in claim 4, wherein all said elastomers are spaced from each other.

6. The audio jack as claimed in claim 5, wherein the elastomer can be compressed when the plug is inserted into the receiving space and presses the mating portion, and rebound when the plug is pulled out of the receiving space.

7. The audio jack as claimed in claim 2, wherein each contact has a contact portion extending into the receiving space from the retaining portion for electrically connecting with the plug.

8. The audio jack as claimed in claim 7, wherein the elastomer is insulative and located behind the contact portion, and the elastomer can be compressed or rebound when the plug is inserted or pulled out of the receiving space.

9. The audio jack as claimed in claim 1, wherein the mounting holes communicate with the receiving space in a transverse direction perpendicular to an insertion direction of the plug, communicate with exterior in a vertical direction perpendicular to the transverse direction and the insertion direction.

10. The audio jack as claimed in claim 1, wherein the elastomeric material is deposited into the mounting holes from the mounting wall in a vertical direction of the insulative housing.

11. A method of making an audio jack as described in claim 1, comprising:

providing an insulative housing with a receiving space which can be inserted into a corresponding plug and a plurality of mounting holes extending inwardly from a mounting wall thereof;

providing a plurality of contacts and assembling the contacts into the mounting holes, each contact having a tail portion exposed to exterior for connecting with a circuit board;

providing a core pin with a shape same to the receiving space and inserting the core pin into the receiving space;

filling a plenty of elastomeric material into the mounting holes around the contacts; and pulling out of the core pin when the elastomeric material is fully filled in the mounting holes and cooled to be solidified.

12. The method of making the audio jack as claimed in claim 11, wherein the elastomeric material forms a plurality of elastomer around the contacts when the elastomeric material is cooled, and each contact has a retaining portion insert molded in the elastomer.

13. The method of making the audio jack as claimed in claim 12, wherein the core pin defines a plurality of depressions at an outer side thereof, the elastomers are conductive and formed with a mating portion respectively corresponding to each depression, and the mating portions extend into the receiving space for electrically connecting the plug and contacts.

14. The method of making the audio jack as claimed in claim 12, wherein the core pin defines a plurality of depressions at an outer side thereof, each contact has a contact portion at a position of the depression, and the contact portion extends into the receiving space from the retaining portion for electrically connecting with the plug.

15. The method of making the audio jack as claimed in claim 14, wherein the elastomer is insulative and located behind the contact portion, and the elastomer can be compressed or rebound when the plug is inserted or pulled out of the receiving space.

16. A hermetic electrical connector for use with a plug, comprising:

an insulative housing defining a columnar main cavity along an axial direction and a plurality of sub-cavities communicatively located beside said main cavity;

a plurality of contact units respectively snugly embedded within the corresponding sub-cavities, respectively, each of said contact units includes a metallic conductive contact and an elastomeric block tightly associated with said contact; wherein in each of said contact units, said contact defines a solder tail exposed outside of the housing for soldering to a printed circuit board, and one of said contact and said elastomeric block forms a contact section extending inwardly radially into the main cavity for mechanical and electrical connection to the plug; wherein the elastomeric block prevents exterior humidity from reaching the printed circuit board via the main cavity.

17. The hermetic electrical connector as claimed in claim 16, wherein in each contact units, the contact section is formed on the metallic contact rather than the elastomeric block.

18. The hermetic electrical connector as claimed in claim 17, wherein said elastomeric is insulative.

19. The hermetic electrical connector as claimed in claim 17, wherein said elastomeric block supports deflection of the corresponding contact when the plug is inserted into the main cavity and mechanically and electrically connects the corresponding contact unit.

20. The hermetic electrical connector as claimed in claim 16, wherein in each contact units, the contact section is formed on the elastomeric block which is conductive.

* * * * *